US009234703B2

(12) United States Patent
Trent, Jr. et al.

(10) Patent No.: US 9,234,703 B2
(45) Date of Patent: Jan. 12, 2016

(54) AUTOMATIC CHARGE HEARTH ACCESS DOOR ASSEMBLY

(71) Applicant: Honda Motor Co., Ltd., Tokyo (JP)

(72) Inventors: Kevin D. Trent, Jr., Sidney, OH (US); Johnrobert J. Teets, Lakeview, OH (US); Patrick A. Merricle, Wapakoneta, OH (US); Lynn Fell, Spencerville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 230 days.

(21) Appl. No.: 14/108,399

(22) Filed: Dec. 17, 2013

(65) Prior Publication Data

US 2015/0168070 A1 Jun. 18, 2015

(51) Int. Cl.
*F27D 1/18* (2006.01)
*F27D 21/00* (2006.01)

(52) U.S. Cl.
CPC ..... *F27D 1/1858* (2013.01); *F27D 21/00* (2013.01); *F27D 2021/0057* (2013.01)

(58) Field of Classification Search
USPC ..... 432/56, 237, 250; 110/173 R, 173 B, 110/176, 172, 177; 373/71
See application file for complete search history.

(56) References Cited

U.S. PATENT DOCUMENTS

| | | | | | |
|---|---|---|---|---|---|
| 510,786 | A * | 12/1893 | Harris | F23L 9/00 | 110/173 R |
| 1,993,786 | A * | 3/1935 | Hollender | F23M 7/00 | 110/176 |
| 2,155,585 | A * | 4/1939 | Davison | F23M 7/00 | 110/105.5 |
| 2,254,900 | A | 9/1941 | Lessmann | | |
| 2,271,411 | A * | 1/1942 | Thwaits | B65D 90/623 | 220/244 |
| 2,532,841 | A * | 12/1950 | Hanff | F23M 7/00 | 110/176 |
| 2,763,343 | A * | 9/1956 | Downey | F16J 13/20 | 110/173 R |
| 3,399,875 | A * | 9/1968 | Ipsen | C21D 1/773 | 110/173 R |
| 4,016,820 | A * | 4/1977 | Johnson | F23M 7/00 | 110/173 R |
| 4,796,543 | A * | 1/1989 | Barkley | F23M 7/00 | 110/173 R |
| 5,591,026 | A | 1/1997 | Imai | | |
| 6,000,938 | A | 12/1999 | Melanowicz | | |
| 6,302,684 | B1 | 10/2001 | Woo et al. | | |
| 6,531,088 | B2 | 3/2003 | Bortoloni | | |
| 6,676,407 | B2 * | 1/2004 | Largent | F23G 5/444 | 432/103 |
| 6,729,245 | B2 * | 5/2004 | Clark | F23M 7/00 | 110/173 R |
| 8,206,642 | B2 * | 6/2012 | Shver | F27B 3/19 | 266/272 |
| 2011/0038391 | A1 | 2/2011 | Mianai et al. | | |

FOREIGN PATENT DOCUMENTS

| | | | | |
|---|---|---|---|---|
| GB | 362228 A * | 12/1931 | | F23M 7/00 |
| JP | 04313684 A * | 11/1992 | | |

* cited by examiner

*Primary Examiner* — Gregory A Wilson
(74) *Attorney, Agent, or Firm* — Rankin, Hill & Clark LLP

(57) ABSTRACT

An automatic charge hearth access door assembly for a melting furnace includes an access door movable between a closed position for covering a furnace opening located on a face of the furnace and an opened position for providing access to the furnace opening. A latch mechanism is configured to automatically secure the access door to the face of the furnace in the closed position. An open-and-close drive assembly includes a motor and arm operably connected to the motor. The open-and-close drive assembly is configured to automatically move the access door relative to the face of the furnace between the closed position and opened position and simultaneously move the access door relative to the arm.

20 Claims, 9 Drawing Sheets

AUTOMATIC CHARGE HEARTH ACCESS DOOR ASSEMBLY

BACKGROUND

Melting furnaces in die cast are used to melt aluminum to produce engine block and head castings. The furnaces have a front door and back access doors to clean the refractory and remove impurities from the aluminum. The front door typically has an automatic lift hoist to open and close the door, but the rear access doors are generally opened, closed, clamped and unclamped manually. The normal push/pull force, as designed by the furnace manufacturer, is about 60 pounds per door based on performed measurements. There is also pushing and pull forces attributed to the manual locking clamps. However, the typical operator cannot assert enough force to hold the door tightly closed resulting in heat loss and damage of the rear plate. Further, for safety concerns, there is a need to prevent the operator from physically contacting the door to open it and to prevent the operator from being in the general area of the furnace while the rear access doors are opening.

BRIEF DESCRIPTION

In accordance with one aspect, an automatic charge hearth access door assembly for a melting furnace comprises an access door movable between a closed position for covering a furnace opening located on a face of the furnace and an opened position for providing access to the furnace opening. A latch mechanism is configured to automatically secure the access door to the face of the furnace in the closed position. An open-and-close drive assembly includes a motor and arm operably connected to the motor and the access door. The open-and-close drive assembly is configured to automatically move the access door relative to the face of the furnace between the closed position and opened position and simultaneously move the access door relative to the arm.

In accordance with another aspect, an automatic charge hearth access door assembly for a melting furnace comprises an access door movable between a closed position for covering a furnace opening located on a face of the furnace and an opened position for providing access to the furnace opening. A latch mechanism is configured to automatically secure the access door to the face of the furnace in the closed position. The latch mechanism is configured to engage the access door in at least two locations about a periphery of the access door thereby creating a seal between the access door and the face of the furnace. An open-and-close drive assembly is configured to automatically move the access door about a first rotational axis between the closed position and opened position and simultaneously move the access door about a second rotational axis which is parallel to and offset from the first rotational axis.

In accordance with yet another aspect, a method of automatically moving a charge hearth access door for a melting furnace between a closed position for covering a furnace opening located on a face of the furnace and an opened position for providing access to the furnace opening is provided. The method comprises moving the access door about a first rotational axis between the closed position and opened position; simultaneously moving the access door about a second rotational axis which is parallel to and offset from the first rotational axis; and sensing presence of an operator in a protected area associated with the access door and preventing movement of the access door when it is determined that an operator is in the protected area.

DETAILED DESCRIPTION

It should, of course, be understood that the description and drawings herein are merely illustrative and that various modifications and changes can be made in the structures disclosed without departing from the present disclosure. In general, the figures of the exemplary automatic charge hearth access door assembly are not to scale. It will also be appreciated that the various identified components of the exemplary automatic charge hearth access door assembly disclosed herein are merely terms of art that may vary from one manufacturer to another and should not be deemed to limit the present disclosure.

Figure 10:
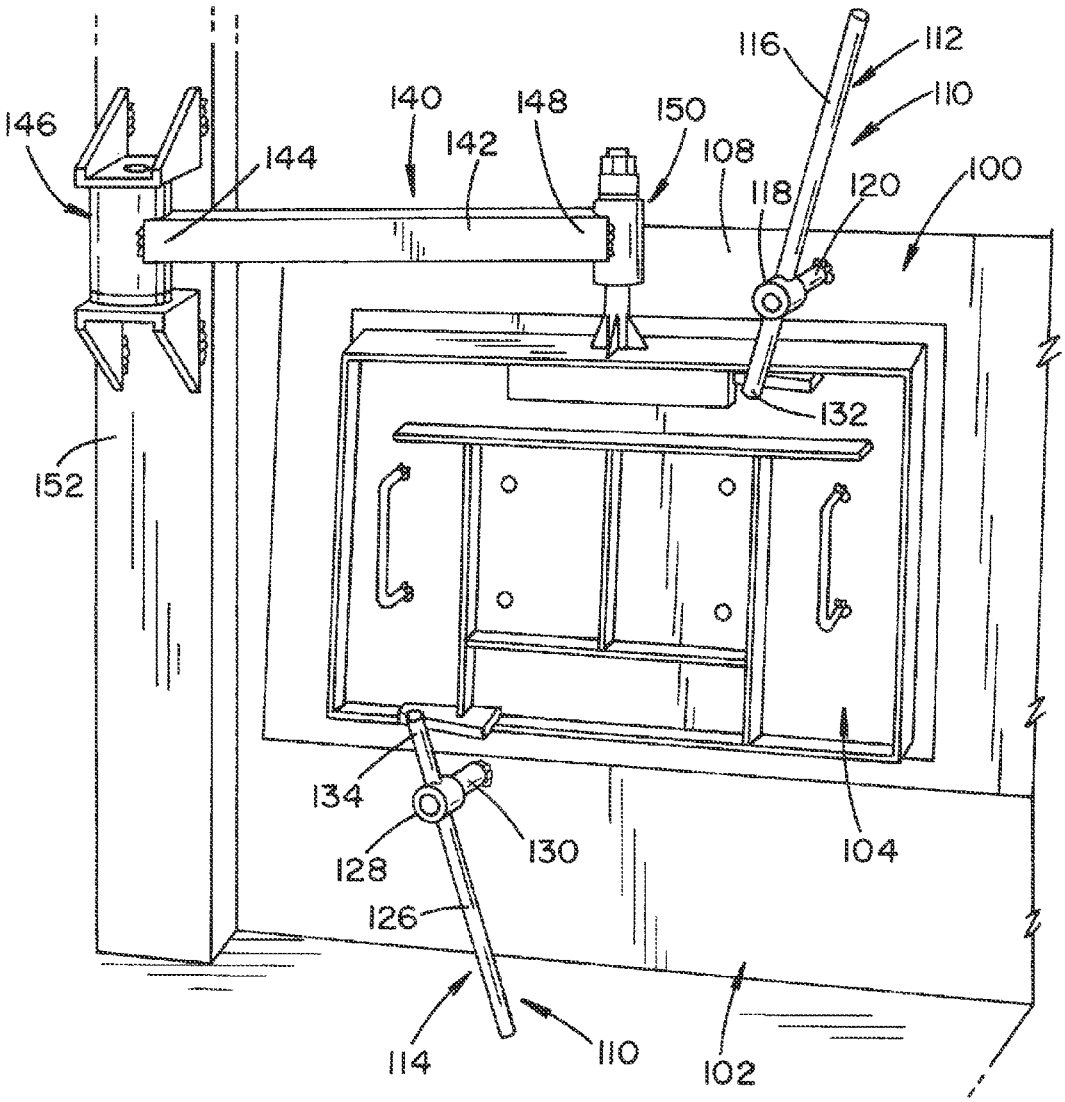
FIG. 10 (PRIOR ART)
FIG. 10 is a schematic view of a known hearth access door assembly for a melting furnace.

Referring now to the drawings, wherein like numerals refer to like parts throughout the several views, FIG. 10 illustrates a known hearth access door assembly 100 for a melting furnace 102. The assembly 100 includes an access door 104 movable between a closed position for covering a furnace opening (not shown) located on a face 108 of the furnace 102 and an opened position for providing access to the furnace opening. A manual latch mechanism 110 is configured to secure the access door 104 to the face 108 of the furnace in the closed position. The latch mechanism 110 can include a first latch mechanism 112 for engaging an upper portion of the access door 104 and a second latch mechanism 114 for engaging a lower portion of the access door 104. The first latch mechanism 112 includes a bar 116 rotatably connected to an end portion 118 of a post 120. The post 120 is fixedly attached to the face 108 of the furnace adjacent the upper portion of the access door 104. Similarly, the second latch mechanism 114 includes a bar 126 rotatably connected to an end portion 128 of a post 130. The post 130 is fixedly attached to the face 108 of the furnace adjacent the lower portion of the access door 104. An end portion 132, 134 of each respective bar 116, 126 engages the access door 104 to maintain the access door in its closed position. To disengage the first and second latch mechanisms 112, 114, the bars 116, 126 are rotated out of engagement with the access door 104. This, in turn, allows the access door 104 to be manually moved from the closed position to the opened position. To this end, an open-and-close assembly 140 is configured to move the access door 104 the closed position and opened position. The assembly 140 includes an arm 142 having a proximal end portion 144 connected to a first pivot 146 and a distal end portion 148 connected to a second pivot 150. The first pivot 146 is mounted to a supporting structure 152. The access door 104 is mounted to the second pivot 150. Thus, with the known assembly 100, an operator is required to physically contact the access door 104 to move the access door to the opened position to gain access to the furnace opening.

Figure 1:
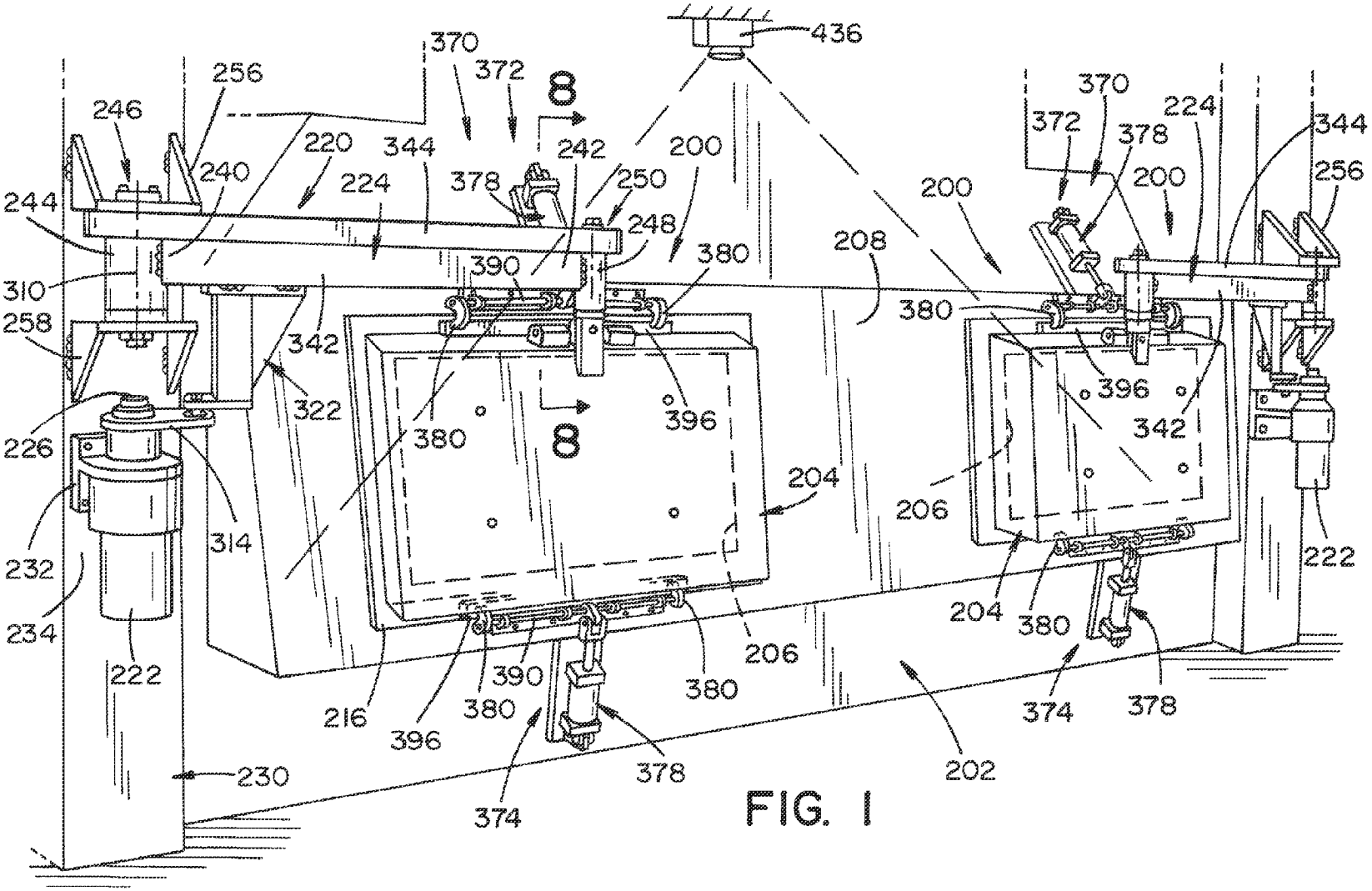
FIGS. 1 and 2 are schematic views of an automatic charge hearth access door assembly for a melting furnace.
Figure 2:
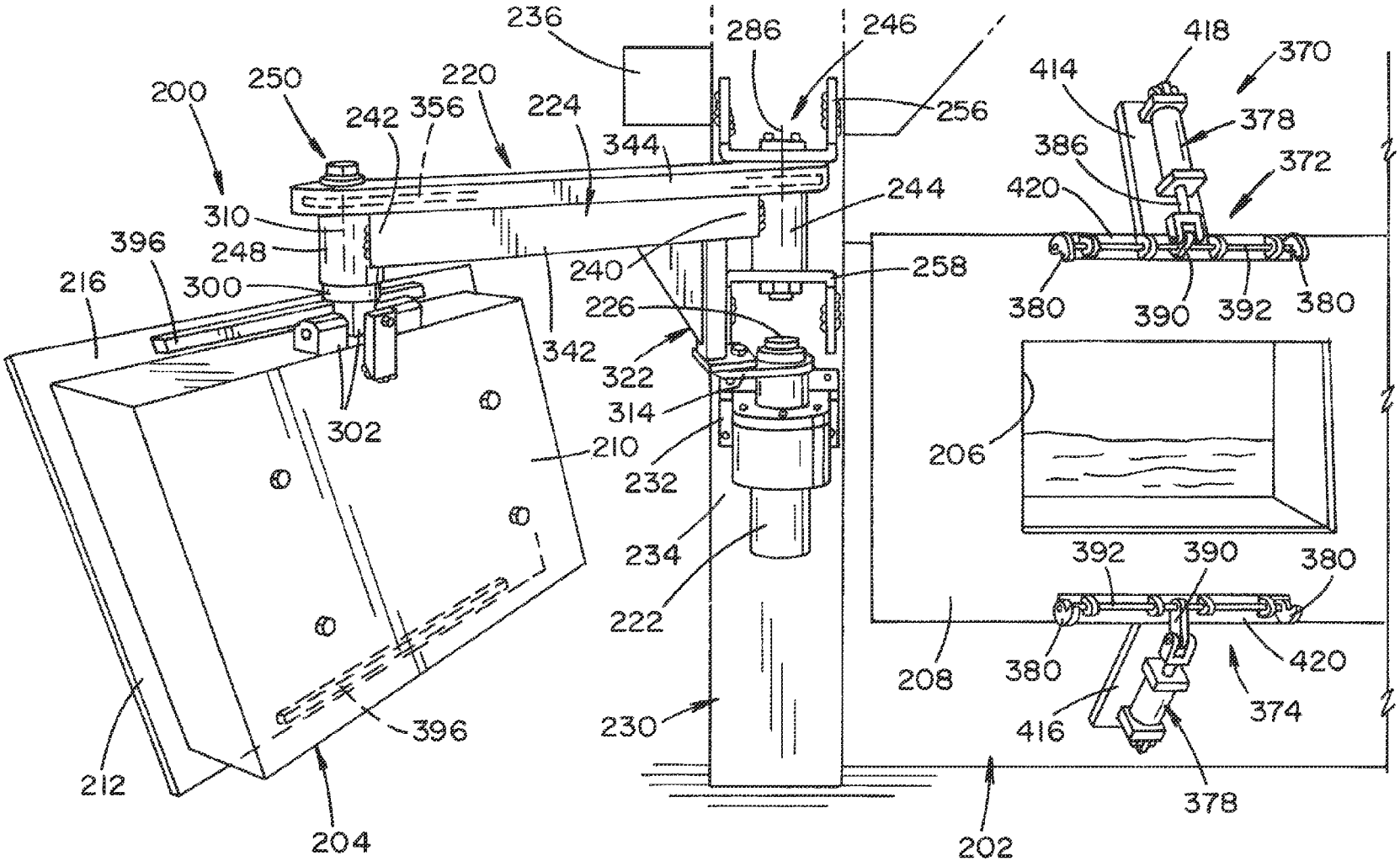

FIGS. 1 and 2 schematically depict a pair of exemplary automatic charge hearth access door assemblies 200 for a melting furnace 202 according to the present disclosure. The assemblies 200 are mirror images of each other; therefore, only one assembly will be described with particularity. The assembly 200 includes an access door 204 movable between a closed position (FIG. 1) for covering a furnace opening 206 located on a face 208 of the furnace and an opened position (FIG. 2) for providing access to the furnace opening 206. The access door 204 includes a body 210 having a first portion 212 dimensioned to cover the furnace opening 206 and sealingly engaging the face 208 of the furnace 202 and a second portion 214. The second portion 214 is at least partially received in the furnace opening 206 and can be formed of a material with a high thermal insulation and chemical resistance to corundum formation. The first portion 212 includes a flange 216 which extends about at least an upper and lower periphery of the access door 204. As depicted, the face 208 of the melting furnace 202 can be inclined and the assembly 200 is configured to properly position the access door 204 on the face 208 to ensure that the first portion 212 of the access door is covering the furnace opening 206 and sealed against the face 208 in the closed position of the access door.

Figure 3:
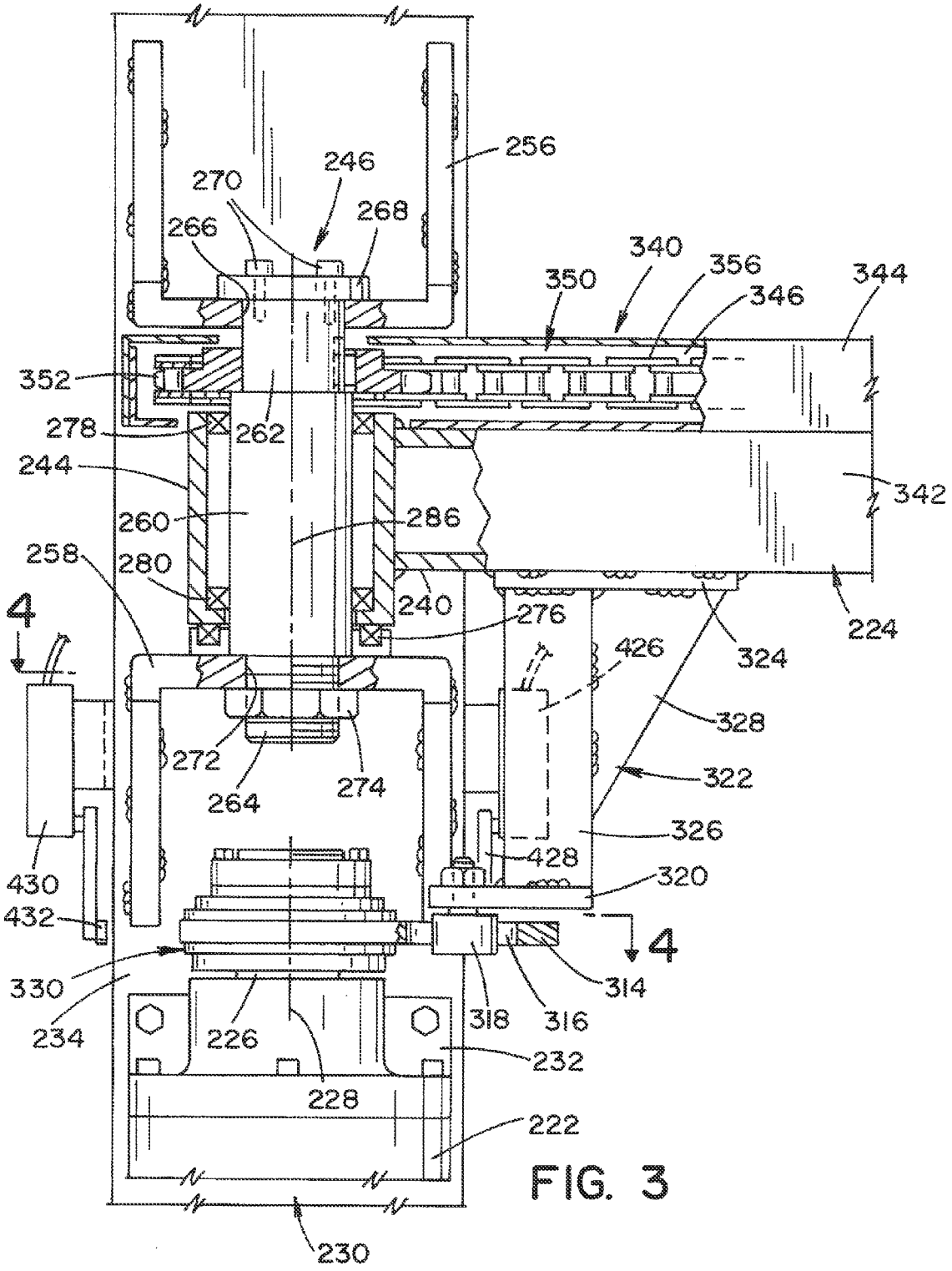
FIG. 3 is a partial cross-sectional view of an open-and-close drive assembly of the automatic charge hearth access door assembly of FIG. 1.

The exemplary automatic charge hearth access door assembly 200 further includes an open-and-close drive assembly 220 configured to automatically move the access door 204 between the closed position and open position. According to one aspect, the open-and-close drive assembly 220 includes a motor 222 (e.g., a gear reduction motor) and an arm 224 operably connected to the motor and the access door 204. The motor 222 can be one of a pneumatic/hydraulic motor and an electric motor and can be configured to allow the access door 204 to be incrementally moved or maintained in any position along its travel. As shown, the motor 222 is positioned beneath the arm 224 and has a vertically oriented output 226 operably connected to the arm 224 in order to rotate the arm forward or reverse when the motor is operated. It should be appreciated that the output 226 defines a rotational axis 228 of the motor 222 (FIG. 3). The motor 222 is mounted to a supporting structure 230 provided adjacent the face 208 of the melting furnace 202. A mounting bracket 232 is secured to the motor 222 and is affixed to a surface 234 of the supporting structure 230. The motor 222 is controlled by door opening/closing switches provided on or in a control unit 236 mounted on the supporting structure 230 (FIG. 2).

With continued reference to FIGS. 1 and 2, the arm 224 suspends the access door 204 from the supporting structure 230 and has a proximal end portion 240 connected to the supporting structure and a distal end portion 242 connected to the access door 204. More particularly, the proximal end portion 240 of the arm 224 is provided with a sleeve 244 for connecting the proximal end portion to a first pivot 246 and the distal end portion 242 of the arm 224 is provided with a sleeve 248 for connecting the distal end portion to a second pivot 250. The first pivot 246 is mounted to the supporting structure 230 by at least one bracket. According to one aspect, the at least one bracket is a first upper mounting bracket 256 secured to both the proximal end portion 240 and an upper part of the first pivot 246 and a second lower mounting bracket 258 secured to a lower part of the first pivot 246.

As shown in FIG. 3, the exemplary first pivot 246 can include a cylindrical body 260 having a first end portion 262 and a second end portion 264. The first end portion 262, which can have a reduced diameter, is mounted to the first mounting bracket 256. Particularly, the first end portion 262 can be inserted through an opening 266 provided in the first mounting bracket 256 and a separate cap 268 having a dimension greater than a diameter of the opening 266 can then be secured to the first end portion 262 via fasteners 270. The second end portion 264 of the cylindrical body 260, which can also have a reduced diameter, is mounted to the second mount bracket 258. Particularly, the second end portion 264 can be inserted through an opening 272 provided in the second mounting bracket 258. According to one aspect, the second end portion can include threads and a nut 274 is threaded onto the second end portion 264 and into engagement with the second mounting bracket 258. Therefore, it should be appreciated that the cylindrical body 260 is fixed to the first and second mounting brackets 256, 256 and does not rotate. To that end, further provided with the first pivot 246 is a bearing 276 located between the sleeve 244 and the second mounting bracket 258. The bearing 276 facilitates rotation of the proximal end portion 240 of the arm 224 about the cylindrical body 260 of the first pivot 246. Additional bearings 278, 280 can be located between an inner surface of the sleeve 244 and the cylindrical body 260. Accordingly, the first pivot 246 defines a rotational axis 286, and as depicted in FIG. 3, the rotational axis 286 is parallel to and aligned with the rotational axis 228 of the output 226 of the motor 222.

Figure 8:
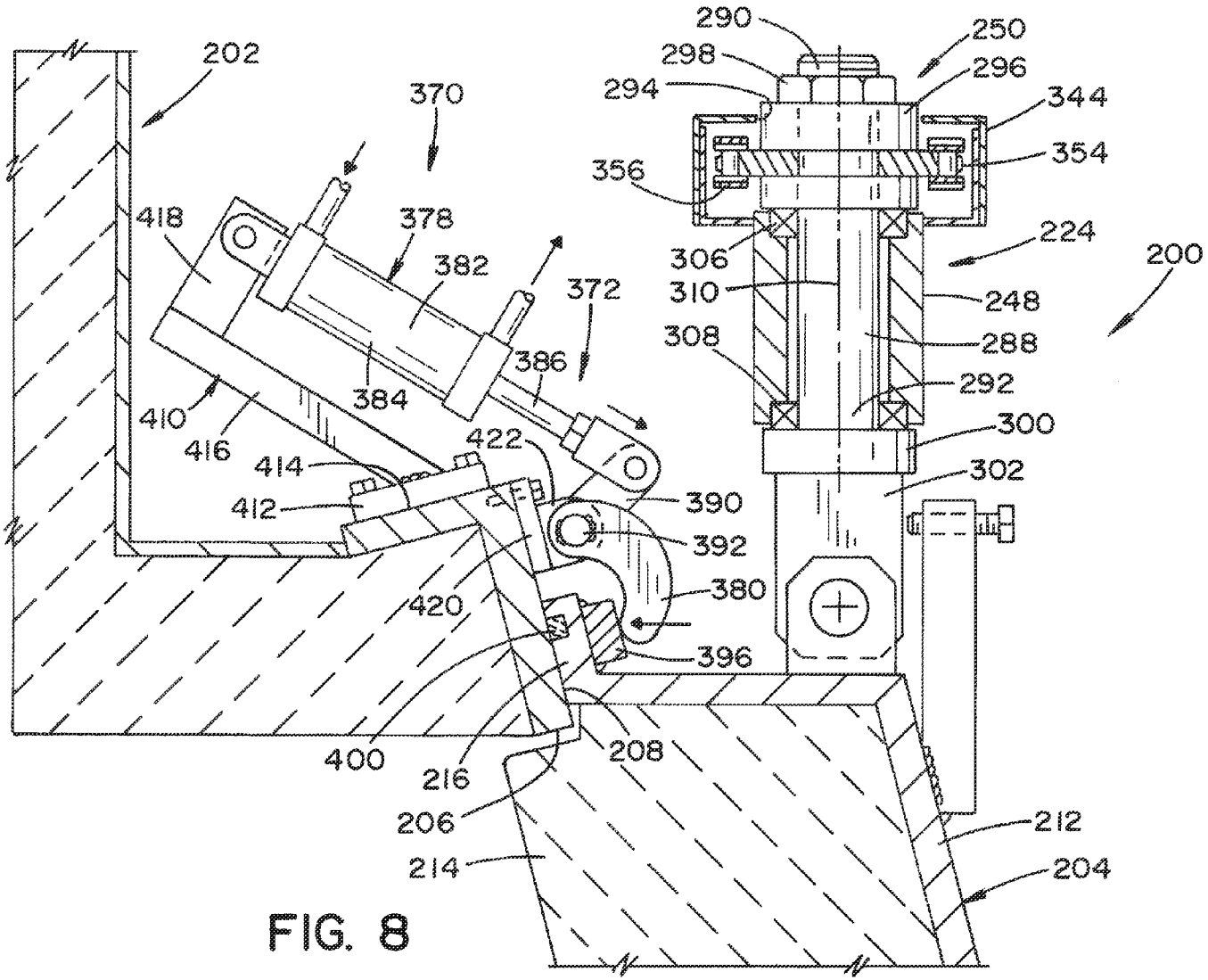
FIG. 8 is a cross-sectional view taken along line 8-8 of FIG. 1 and showing a latching mechanism in a closed position.

The access door 204 is mounted to the second pivot 250 for rotation therewith. Details of the second pivot 250 are shown in FIG. 8. As depicted therein, the exemplary second pivot 250 includes a cylindrical body 288 having a first end portion 290 and a second end portion 292. The first end portion 290, which can be threaded, extends through an opening 294 in the distal end portion 242 of the arm 224 and a hub 296 housed in the distal end portion 242. A nut 298 is threaded onto the first end portion 290 and engages the hub 296. The second end portion 292 is mounted to hub 300 secured to a support 302 associated with the access door 204. Bearings 306, 308 located between an inner surface of the sleeve 248 and the cylindrical body 288 facilitate rotation of the cylindrical body 288. Therefore, according to the present disclosure, the access door 204 is supported on the distal end portion 242 of the arm 224 only by the second pivot 250. Further, and in contrast to the cylindrical body 260 of the first pivot 246, it should be appreciated that the cylindrical body 288 of the second pivot 250 rotates as the access door 204 is moved between the closed position and opened position. Accordingly, the second pivot 250 defines a rotational axis 310 parallel to and offset from the rotational axis 228 of the output 226 of the motor 222. With the above described arrangement of the first and second pivots 246, 250, the motor 222 is not directly coupled to either of the first and second pivots.

Figure 4:
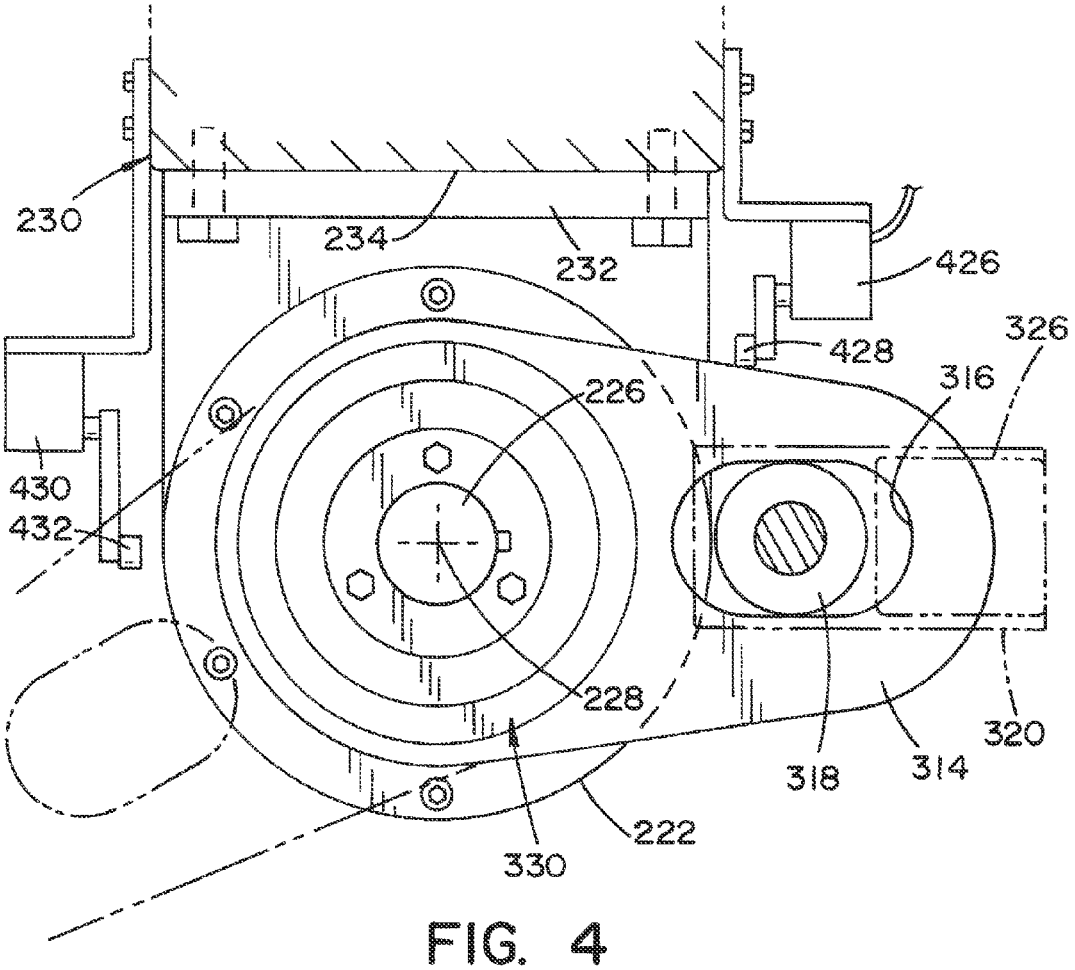
FIG. 4 is a view taken along line 4-4 of FIG. 3

The open-and-close drive assembly 220 is configured to automatically move the access door 204 relative to the face 208 of the furnace 202 between the closed position and opened position and simultaneously move the access door 204 relative to the arm 224. Particularly, the arm 224 has the proximal end portion 240 pivotally connected to the motor 220 and the distal end portion 242 pivotally connected to the access door 204. As best depicted in FIGS. 3 and 4, to connect the motor 222 to the proximal end portion 240, the motor 222 is provided with a cam plate 314 connected to the motor output 226 and rotatable therewith. A slot 316 is located in the plate 314 and receives a follower or roller 318 connected to the proximal end portion of the arm 224. The roller 318 is mounted to a lower base member 320 of an extension assembly 322 provided beneath the proximal end portion 240 of the arm 224. The extension assembly 322 further includes an upper base member 324 secured to the proximal end portion 240 and an arm member 326 interconnecting the lower and upper base members 320, 324. A gusset 328 can be secured to the upper base member 324 and arm member 326 to provide additional strength and rigidity to the extension assembly and, in turn, the proximal end portion 240 of the arm 224. Further, the motor 222 of the open-and-close drive assembly 220 includes at least one torque clutch plate 330 operably associate with the plate 314. It should be appreciated that as the arm 224 rotates the access door 204 between the closed position and the opened position, the roller 318 moves on the cam plate 314. The torque clutch plate 330 prevents damage to the motor 222 should the access door 204 be prevented from moving between the closed position and opened position (i.e., the cam plate 314 is prevent from rotating together with the motor output 226).

The arm 224 at least partially houses a drive mechanism 340 of the open-and-close drive assembly 220. As best depicted in FIGS. 2 and 3, the arm 224 includes a lower part 342 and a separate upper part 344 secured to the lower part 342 and defining chamber 346. The sleeves 244, 248 are attached to opposite end portions of the lower part 342. The upper part 344 can be dimensioned to extend at least partially over the sleeves 244, 248, with the cylindrical bodies 260, 288 of the respective first and second pivots 246, 250 being at least partially covered by the upper part 344 (see FIGS. 3 and 8). At least partially housed in the chamber 346 defined by the arm 224 is a sprocket and chain drive 350 of the drive mechanism 340 that operates in conjunction with movement of the arm 224 via operation of the motor 222.

Figure 5:
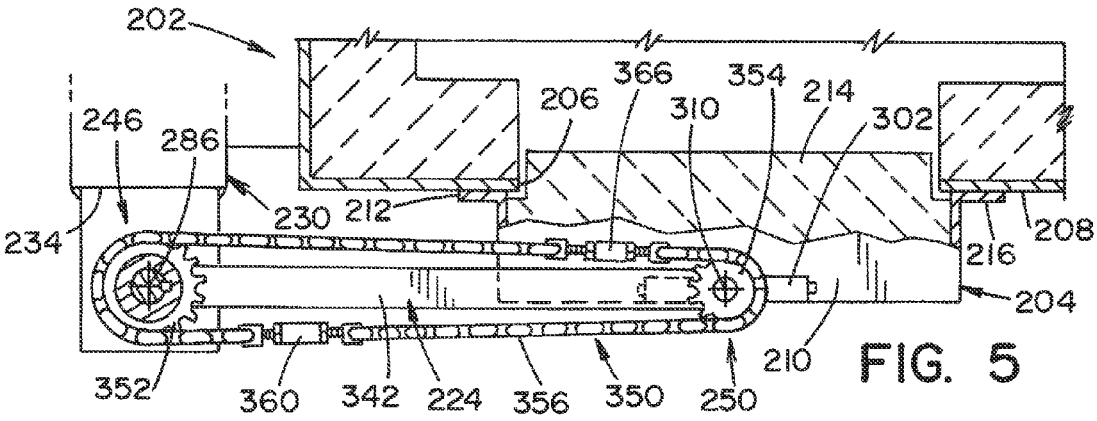
FIG. 5 is a schematic view of the open-and-close drive assembly with an access door in a closed position.
Figure 9:
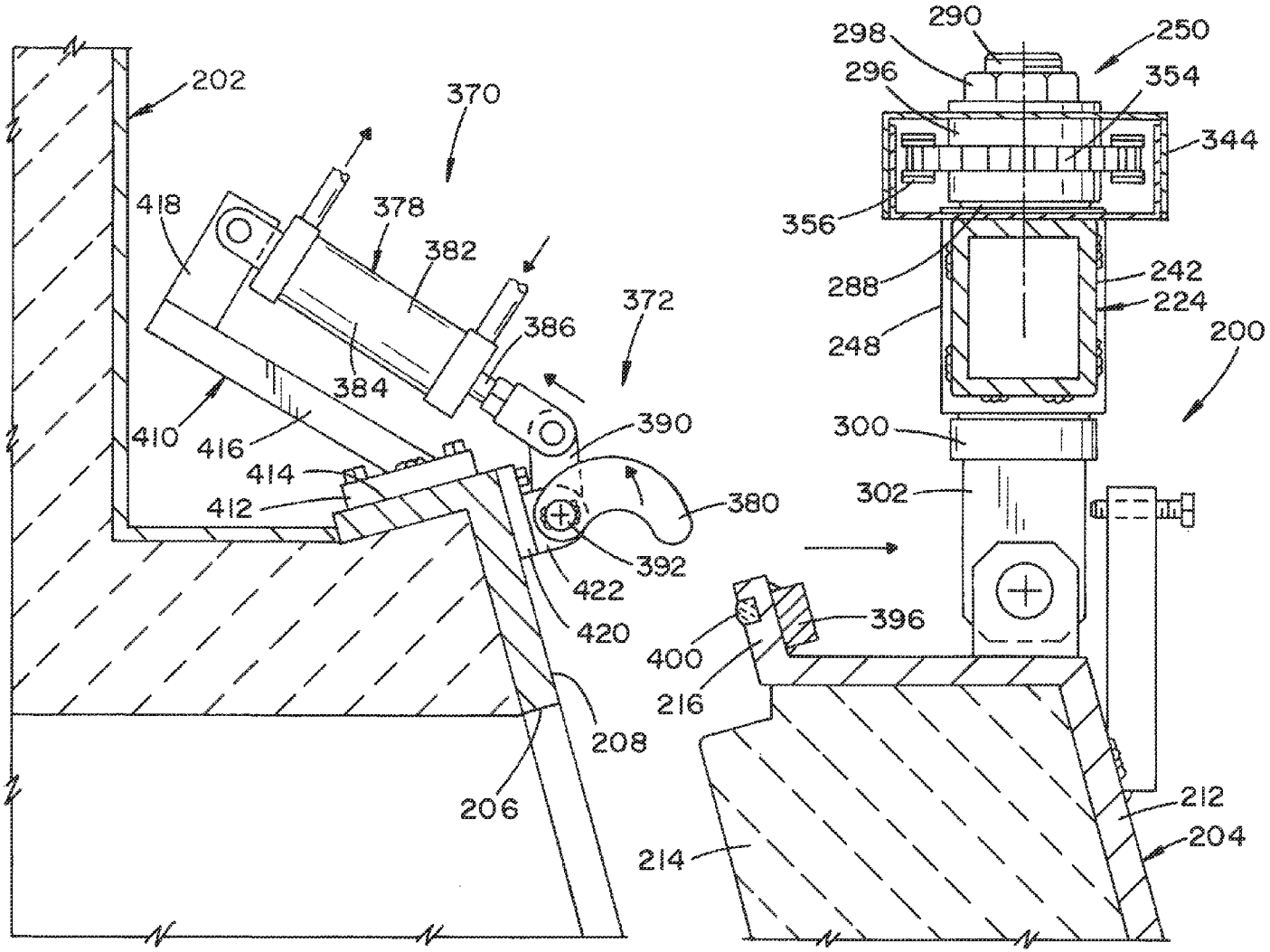
FIG. 9 is a cross-sectional view similar to FIG. 8 showing the latch mechanism in an opened position.

The sprocket and chain drive 350 includes a first sprocket 352, a second sprocket 354 and a drive chain 356 engaged to the first and second sprockets. As shown in FIG. 3, the first sprocket 352 is fixedly connected to the first pivot 246 located at the proximal end portion 240 of the arm 224. More particularly, the first sprocket 352 is mounted to the first end portion 262 of the cylindrical body 260. As indicated previously, the cylindrical body 260 is fixedly attached to the first upper mounting bracket 256 and the second lower mounting bracket 258. As such, the first sprocket 352 does not rotate as the access door 204 is moved between the closed position and opened position. As shown in FIGS. 8 and 9, the second sprocket 354 is rotatably connected to the second pivot 250 located at the distal end portion 242 of the arm 224. More particularly, the second sprocket 354 is fixedly mounted to the hub 296 at least partially housed by the upper part 344 of the arm 224. As indicated previously, because the cylindrical body 288 of the second pivot 250 is at least partially supported by the bearing 306, 308 and is attached to the support 302, the cylindrical body 288 together with the second sprocket 354 can rotate as the access door 204 is moved between the closed position and opened position. The drive chain 356 can include at least one turnbuckle 360 for adjusting the length or tension of the drive chain around the first and second sprockets 352, 354 (FIG. 5). In the depicted embodiment, a pair of turnbuckles 360 is provided with the drive chain 356.

Figure 6:
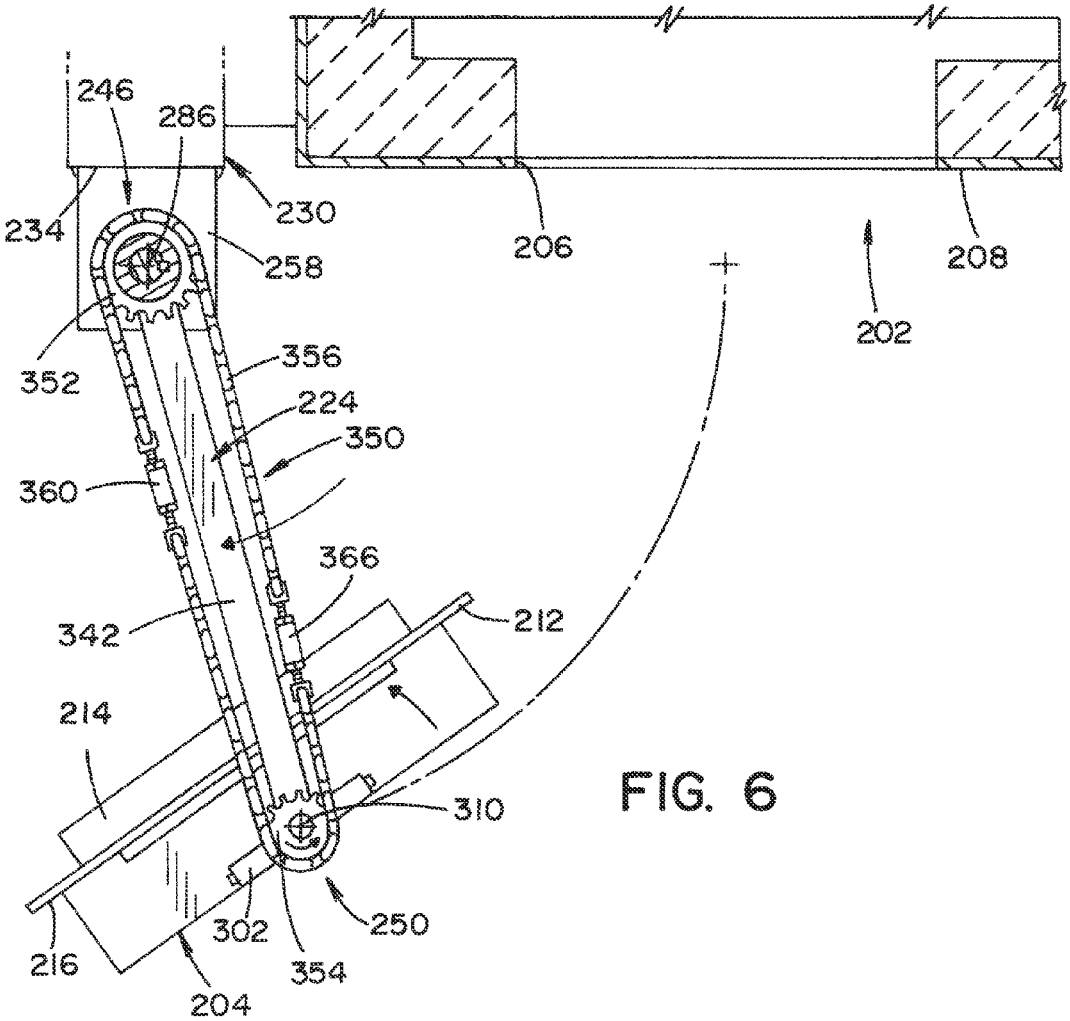
FIG. 6 is a schematic view of the open-and-close drive assembly with an access door in a partially opened position.
Figure 7:
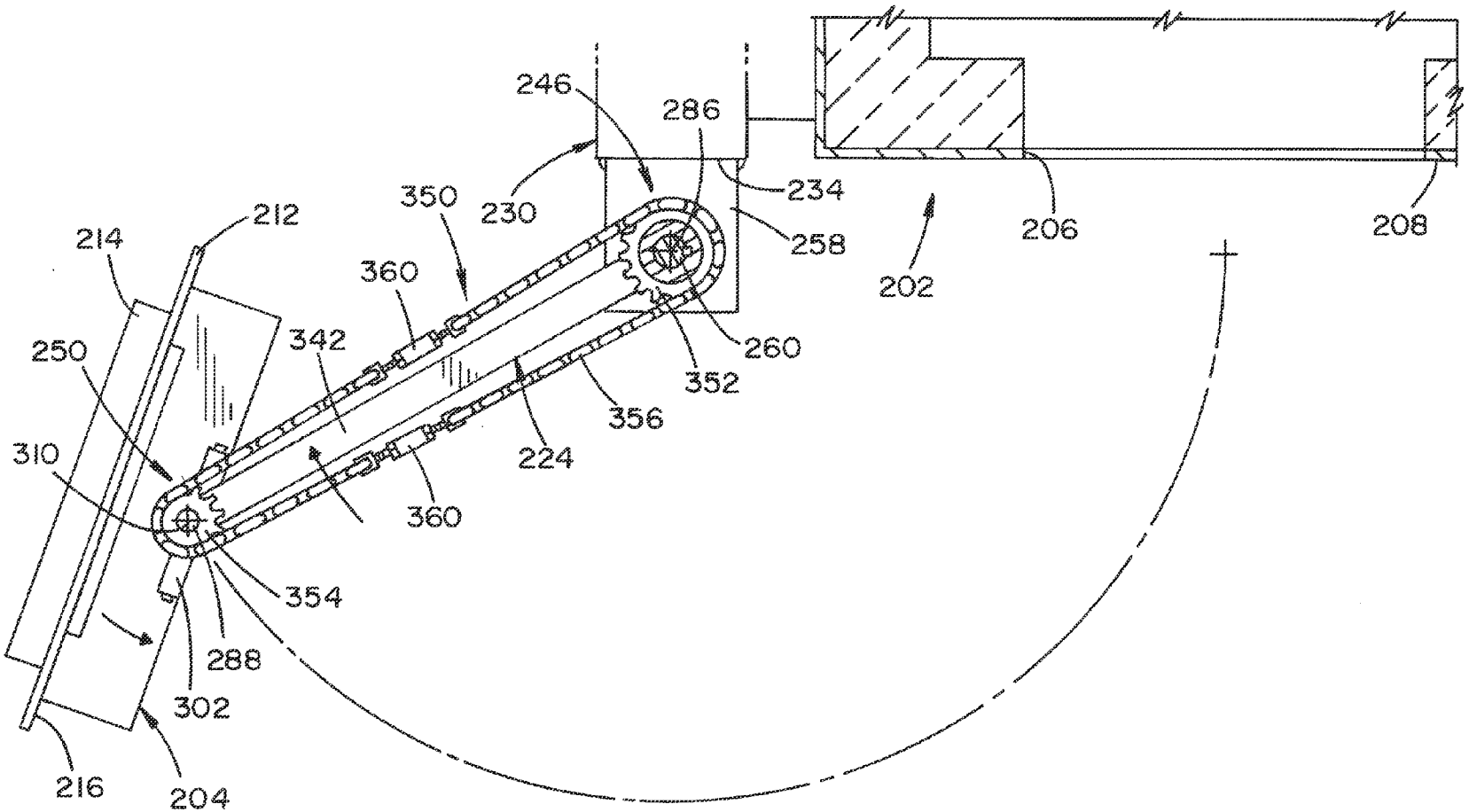
FIG. 7 is a schematic view of the open-and-close drive assembly with an access door in a fully opened position.

FIGS. 5-7 schematically depict the movement of the sprocket and chain drive 350 as the access door 204 moves between the closed position and the opened position. FIG. 5 shows the access door 204 in the closed position. The arm 224 extends across the face 208 of the furnace 202 with the access door properly positioned to cover the furnace opening 206. The first portion 212 of the access door body 210 is sealingly engaged to the face 208 of the furnace 202 and the second portion 214 of the access door body is at least partially received in the furnace opening 206. FIGS. 6 and 7 show the access door 204 moving toward the opened position. The arm 224 rotates about the rotational axis 286 defined by the first pivot 246. As the arm 224 rotates, the drive chain 356 moves around the fixed first sprocket 352, and this movement of the drive chain simultaneously rotates the second sprocket 354 about the rotational axis 310 defined by the second pivot 250. With the second sprocket 354 fixed to the hub 296 of the second pivot 250, rotation of the second sprocket 354 rotates the cylindrical body 288 of the second pivot. As indicated previously, the cylindrical body 288 is fixed to the support 302 associated with the access door 204. Thus, as the second pivot 250 rotates, the support 302 and, in turn, the access door 204, rotates about the rotational axis 310. Therefore, with the exemplary arrangement of the first and second pivots 246, 250, the arm 224 rotates about the rotational axis 286 of the fixed first pivot 246 as the access door 204 moves, and rotation of the arm 224 rotates the second sprocket 354 and second pivot 250 via the drive chain 356, and rotation of the second pivot 250 simultaneously rotates the access door 204 about the rotational axis 310 relative to the arm 224.

With reference back to FIGS. 8 and 9, the exemplary automatic charge hearth access door assembly 200 further includes a latch mechanism 370 secured to the face 208 of the furnace 202 and configured to automatically and immediately secure the access door 204 to the face 208 of the furnace 202 in the closed position. According to one aspect, the latch mechanism 370 is configured to engage the access door 204 in at least two locations about a periphery of the access door 204 to create a seal between the access door and the face 208 of the furnace 202. According to another aspect, the latch mechanism 370 is configured to engage the access door 204 in four spaced locations about the periphery of the access door 204. More particularly, the latch mechanism 370 includes a first or upper latching device 372 and a second or lower latching device 374. Because the second latch device 374 is structurally similar to the first latch device 372, only the features of the first latch device 372 will be described in greater detail. The first latching device 372 includes an actuating device 378 operably connected to an engagement member or clamp 380 for moving the engagement member between a locked position and an unlocked position. In the depicted embodiment, the actuating device 378 is a high temperature pneumatic/hydraulic cylinder 382 having a cylinder barrel 384, in which a piston (not visible) connected to a piston rod 386 moves back and forth. A link 390 is pivotally connected to an end of the piston rod 386. The link is secured to a shaft 392, and fixed to the shaft 392 is the clamp 380. The clamp 380 engages the flange 216 of the access door, and according to one embodiment, engages a separate member 396 provided on the flange 216. This engagement presses a seal 400 (e.g., a rope seal) located on the flange 216 into engagement with the furnace face 208. It should be appreciated that the locked/unlocked positions of the clamps 380 are determined by the stroke of the piston rod 386 of the actuator cylinder 382. The stroke of the actuator cylinder can be set by a sensor (not illustrated) which is integral with the actuating device 378.

As stated above, the latch mechanism 370 includes the first and second latching devices 372, 374. However, it should be appreciated that the latch mechanism 370 can include a single actuating device 378 operably connected to the four spaced clamps 380. As shown in FIG. 2, each of the first and second latching devices 372, 374 is provided with a pair of spaced clamps 380. Thus, the present disclosure provides for the latch mechanism 370 including four spaced clamps 380 and at least one actuating device 378 operably connected to the clamps 380 for immediately moving the clamps into engagement with the access door 204 when the access door is in the closed position. To provide for immediate movement of the clamps 380, the exemplary automatic charge hearth access door assembly 200 can include at least one solenoid (not shown) connected to the actuating devices 378. Prior to moving the access door 204 from the closed position, the solenoid actuates the actuating devices 378 to move the clamps 380 to the unlocked position. The solenoid can be in communication with a door position sensor (not shown) such that when the access door 204 is moved back to the closed position, the solenoid again actuates the actuating devices 378 to move the clamps 380 to the locked position into engagement with the access door 204. Further, at least one pressure switch (not shown) can be provided to confirm that that the locked and unlocked positions of the clamps 380.

Each latching device can be secured to the furnace face 208 by a mounting assembly 410. With reference again to FIGS. 8 and 9, and according to one embodiment, the mounting assembly 410 includes a first base plate 412 mounted to another face 414 of the furnace 202. An extension plate 416 is secured to the first base plate 412 and extends outwardly therefrom. A connecting plate 418 extends from an end portion of the extension plate 416, and the actuating device 378 is mounted to the connecting plate 418. A second base plate 420 is mounted to the face 208 of the furnace 202. The shaft 392 is rotatably mounted to supports 422 provided on the second base plate 420. It should be appreciated that alternative configurations for the mounting assembly 410 are contemplated.

As indicated previously, the motor 222 is controlled by door opening/closing switches provided the control unit 236 mounted on the supporting structure 230 (FIG. 2). The control unit 236 can be configured to establish defined closed/opened positions of the access door 204. By way of example, and as depicted in FIGS. 3 and 4, the control unit 236 can include a limit switch 426 having a contact 428 which is actuated to stop the motor 222 when the access door 204 is tightly closed (i.e., in the closed position sealed against the face 208 of the furnace 202), and a another limit switch 430 having a contact 432 which is actuated to stop the motor 222 when the access door 204 is in the fully opened position. The contacts 428, 432 can be mechanically actuated by, for example, the plate 314, or can be electrically actuated, by, for example, a position sensor (not shown) associated with the access door 204. An emergency stop button (not shown) can also be provided on the control unit 236, and depression of the emergency stop button, even if momentary, will stop the travel of the access door 204 until another control command is issued by the operator. Further, as illustrated in FIG. 1, at least one safety sensor 436 in signal communication with the control unit 236. The control unit 236 prevents movement of the access doors 204 when the safety sensor 436 determines presence of an operator in a protected area associated with the access doors 204.

The exemplary automatic charge hearth access door assembly 200 eliminates the need for the operator to physically contact the access door 204 to open it and also prevents the operator from being in the general area of the furnace 202 while the access door 204 is opening. The control unit 236 is provided for unlocking the access door 204 and moving the access door 204 between the closed position and the open position. The latch mechanism 370 utilizes high temperature actuating devices 378 to latch the rear access door 204 closed in four locations. This creates an improved seal of the rear access door to the face 208 of the furnace 202. Due to the angle of the rear access door 204 and the furnace face 208, the position of the clamps 380 allow variation in insulation material thickness as the access door 204 wears over time. The open-and-close drive assembly 220 includes the motor 222 and arm 224. The cam plate 314 associated with the arm 224 allows extra tolerance related to alignment and location of the motor 222 to accommodate discrepancies between furnaces. There is also the additional second pivot 250 to allow the operator to move the hot side of the door away from the operator during cleaning. The second pivot 250 utilizes the sprocket and chain drive 350 that turns in conjunction with movement of the arm 224. Further, the motor 222 is equipped with torque clutch plates 330 to prevent damage to the motor should the rear doors be prevented from opening. The area around the access doors 204 is protected via the safety sensor 436 which prevents operation of the rear access doors 204 if an operator is within a protected area. The control unit 236 allows the operator to automatically open and close the rear doors 204, both doors at the same time or one door at a time.

It should also be appreciated that exemplary automatic charge hearth access door assembly 200 can be associated with a mechanical arm (not shown), such as an arm provided on a robot, operable to clean the melting furnace 202 with the access door 204 in the opened position. The mechanical arm can be operated by the control unit 236, and can be configured to automatically move into position near the face 208 of the furnace 202 after the access door 204 is opened. After cleaning, the mechanical arm can be configured to automatically return to its prior position, which allows the access door 204 to move back to its closed position.

In accordance with the present disclosure, a method of automatically moving a charge hearth access door 204 for a melting furnace 202 between a closed position for covering a furnace opening 206 located on a face 208 of the furnace and an opened position for providing access to the furnace opening is provided. The method comprises moving the access door 204 about a first rotational axis 286 between the closed position and opened position; simultaneously moving the access door 204 about a second rotational axis 310 which is parallel to and offset from the first rotational axis 286; and sensing presence of an operator in a protected area associated with the access door 204 and preventing movement of the access door 204 when it is determined that an operator is in the protected area. The method further comprises immediately securing the access door 204 to the face 208 of the furnace 202 in the closed position and creating a seal between the access door 204 in the closed position and the face 208 of the furnace 202 by engaging the access door 204 to the face 208 of the furnace at four spaced locations about a periphery of the access door 204.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. Automatic charge hearth access door assembly for a melting furnace comprising:

an access door movable between a closed position for covering a furnace opening located on a face of the furnace and an opened position for providing access to the furnace opening;

a latch mechanism configured to automatically secure the access door to the face of the furnace in the closed position; and an open-and-close drive assembly including a motor and arm operably connected to the motor and the access door, the open-and-close drive assembly configured to automatically move the access door relative to the face of the furnace between the closed position and opened position and simultaneously move the access door relative to the arm.

2. The assembly of claim 1, wherein the latch mechanism is configured to engage the access door in four spaced locations about a periphery of the access door thereby creating a seal between the access door and the face of the furnace.

3. The assembly of claim 2, wherein the latch mechanism includes four spaced clamps and at least one actuating device operably connected to the clamps for immediately moving the clamps into engagement with the access door when the access door is in the closed position.

4. The assembly of claim 3, wherein the at least one actuating device is at least one high temperature pneumatic cylinder having a piston rod operably connected to at least one shaft having the clamps mounted thereto, movement of the piston rod rotating the shaft, and, in turn, moving the clamps.

5. The assembly of claim 1, wherein the arm of the open-and-close drive assembly has a proximal end portion pivotally connected to the motor and a distal end portion pivotally connected to the access door, the arm at least partially housing a drive mechanism of the open-and-close drive assembly.

6. The assembly of claim 5, wherein the drive mechanism includes a sprocket and chain drive that operates in conjunction with movement of the arm via operation of the motor.

7. The assembly of claim 6, wherein the sprocket and chain drive includes a first sprocket fixedly connected to a first pivot located at the proximal end portion of the arm, a second sprocket connected to a second pivot located at the distal end portion of the arm, the second sprocket rotating with the second pivot, and a drive chain engaged to the first and second sprockets.

8. The assembly of claim 7, wherein the proximal end portion of the arm is connected to the first pivot and the access door is connected to the second pivot, wherein the arm rotates about the first pivot, and rotation of the arm rotates the second sprocket and second pivot via the drive chain, rotation of the second pivot rotating the access door.

9. The assembly of claim 7, wherein the motor includes an output which defines a rotational axis and a rotational axis defined by the first pivot is parallel to and aligned with the rotational axis of the output, and wherein a rotational axis defined by the second pivot is parallel to and offset from the rotational axis of the output.

10. The assembly of claim 7, wherein the motor is not directly coupled to either of the first and second pivots.

11. The assembly of claim 10, wherein the open-and-close drive assembly further includes a cam plate connected to the motor and a follower connected to the proximal end portion of the arm, the follower being movable on the cam plate as the arm rotates the access door between the closed position and the opened position.

12. The assembly of claim 7, wherein the access door is supported on the arm only by the second pivot.

13. The assembly of claim 1, further including at least one safety sensor in signal communication with a control unit, the control unit preventing movement of the access door when the at least one safety sensor determines presence of an operator in a protected area associated with the access door.

14. An automatic charge hearth access door assembly for a melting furnace comprising:

an access door movable between a closed position for covering a furnace opening located on a face of the furnace and an opened position for providing access to the furnace opening;

a latch mechanism configured to automatically secure the access door to the face of the furnace in the closed position, the latch mechanism configured to engage the access door in at least two locations about a periphery of the access door creating a seal between the access door and the face of the furnace; and an open-and-close drive assembly configured to automatically move the access door about a first rotational axis between the closed position and opened position and simultaneously move the access door about a second rotational axis which is parallel to and offset from the first rotational axis.

15. The assembly of claim 14, wherein the open-and-close drive assembly includes a motor and arm operably connected to the motor, a proximal end portion of the arm includes a first pivot which defines the first rotational axis and a distal end portion of the arm includes a second pivot which defines the second rotational axis.

16. The assembly of claim 15, wherein the arm at least partially houses a drive mechanism including a sprocket and chain drive that operates in conjunction with movement of the arm via operation of the motor, wherein the sprocket and chain drive includes a first sprocket fixedly and non-rotatably connected to the first pivot, a second sprocket connected to the second pivot for rotation therewith, and a drive chain engaged to the first and second sprockets.

17. The assembly of claim 15, wherein the access door is connected to the second pivot, and rotation of the arm about the first pivot rotates the second pivot via the drive chain, rotation of the second pivot rotating the access door.

18. The assembly of claim 14, wherein the latch mechanism includes four spaced clamps and at least one drive device operably connected to each of the clamps for automatically moving the clamps into engagement with the access door.

19. A method of automatically moving a charge hearth access door for a melting furnace between a closed position for covering a furnace opening located on a face of the furnace and an opened position for providing access to the furnace opening, the method comprising:

moving the access door about a first rotational axis between the closed position and opened position;

simultaneously moving the access door about a second rotational axis which is parallel to and offset from the first rotational axis; and sensing presence of an operator in a protected area associated with the access door and preventing movement of the access door when it is determined that an operator is in the protected area.

20. The method of claim 19, further comprising securing the access door to the face of the furnace in the closed position and creating a seal between the access door in the closed position and the face of the furnace by engaging the access door to the face of the furnace at four spaced locations about a periphery of the access door.

* * * * *